US010668322B2

(12) United States Patent
Chen

(10) Patent No.: US 10,668,322 B2
(45) Date of Patent: Jun. 2, 2020

(54) CLIMBING MACHINE

(71) Applicant: Hsien Chu Chen, Taichung (TW)

(72) Inventor: Hsien Chu Chen, Taichung (TW)

( * ) Notice: Subject to any disclaimer, the term of this patent is extended or adjusted under 35 U.S.C. 154(b) by 64 days.

(21) Appl. No.: 16/185,197

(22) Filed: Nov. 9, 2018

(65) Prior Publication Data

US 2019/0381349 A1 Dec. 19, 2019

(30) Foreign Application Priority Data

Jun. 15, 2018 (TW) ..... 107208051 U

(51) Int. Cl.

| | |
|---|---|
| ***A63B 22/04*** | (2006.01) |
| ***A63B 21/00*** | (2006.01) |
| ***A63B 23/04*** | (2006.01) |
| ***A63B 22/00*** | (2006.01) |

(52) U.S. Cl.

CPC ..... *A63B 22/04* (2013.01); *A63B 21/00069* (2013.01); *A63B 21/00192* (2013.01); *A63B 21/4034* (2015.10); *A63B 22/0015* (2013.01); *A63B 23/0405* (2013.01); *A63B 2209/08* (2013.01)

(58) Field of Classification Search

CPC ..... A63B 22/04; A63B 21/00192; A63B 21/00069; A63B 23/0405; A63B 21/4034; A63B 22/0015; A63B 2209/08

See application file for complete search history.

(56) References Cited

U.S. PATENT DOCUMENTS 3,592,466 A * 7/1971 Parsons ..... A63B 22/0023 482/53
4,496,147 A * 1/1985 DeCloux ..... A63B 21/0083 482/113
4,708,338 A * 11/1987 Potts ..... A63B 21/023 482/52
4,726,581 A * 2/1988 Chang ..... A63B 22/04 482/113
4,998,725 A * 3/1991 Watterson ..... A63B 21/015 345/38
5,139,470 A * 8/1992 Wang ..... A63B 21/0083 482/113
5,207,621 A * 5/1993 Koch ..... A63B 22/0056 482/112
5,242,341 A * 9/1993 Yeh ..... A63B 22/04 482/52
5,328,427 A * 7/1994 Sleamaker ..... A63B 21/154 482/110

(Continued)

*Primary Examiner* — Garrett K Atkinson

(57) ABSTRACT

A climbing machine includes a base; two sets of two inclined parallel rails wherein each rail has one end secured to a joining portion of a handlebar and the base and the other end rested on the ground; two pedals slidably mounted on the rails respectively; two spaced first wheels mounted forwardly of the rails; a magnetic resistance controlling device configured to add difficulty to motion and including a conductive disc, a curved groove member releasably secured to an edge of the conductive disc, magnetic elements disposed on two inner walls of the curved groove member, an axle disposed in the base, and at least one roller rotatably mounted on the axle; and at least one first rope each extending from the first wheel to wind around the roller prior to attaching to the pedal. In response to rotating the roller, the conductive disc rotates.

19 Claims, 15 Drawing Sheets

(56) References Cited

U.S. PATENT DOCUMENTS 5,352,166 A * 10/1994 Chang ..... A63B 22/04 482/37
5,403,252 A * 4/1995 Leon ..... A61B 5/221 482/5
5,685,804 A * 11/1997 Whan-Tong ..... A63B 22/001 482/51
5,769,759 A * 6/1998 Alter ..... A63B 22/04 482/37
6,036,622 A * 3/2000 Gordon ..... A63B 21/154 482/51
6,146,313 A * 11/2000 Whan-Tong ..... A63B 22/001 482/51
6,482,130 B1 * 11/2002 Pasero ..... A63B 22/001 482/51
6,939,271 B1 * 9/2005 Whan-Tong ..... A63B 22/001 482/52
7,594,877 B2 * 9/2009 Anderson ..... A63B 21/154 482/51
7,731,635 B2 * 6/2010 Dyer ..... A63B 22/0664 482/52
7,780,577 B2 * 8/2010 Arnold ..... A63B 22/001 482/51
7,815,549 B2 * 10/2010 Crawford ..... A63B 24/0087 482/52
7,887,464 B1 * 2/2011 Jones ..... A61H 1/0214 482/51
7,927,257 B2 * 4/2011 Patel ..... A63B 21/00181 482/142
8,277,366 B2 * 10/2012 Savane ..... A63B 22/0056 482/112
8,702,571 B2 * 4/2014 Fenster ..... A63B 22/04 482/52
8,974,353 B2 * 3/2015 Fenster ..... A63B 22/04 482/52
9,216,317 B2 * 12/2015 Golen, Jr. ..... A63B 22/04
9,238,158 B2 * 1/2016 Strommen ..... A63B 22/04
9,370,680 B1 * 6/2016 Macaulay ..... A63B 21/0552
9,789,355 B1 * 10/2017 Lo ..... A63B 22/04
9,993,682 B2 * 6/2018 Johnson ..... A63B 21/0051
10,105,568 B2 * 10/2018 Golen, Jr. ..... A63B 22/04
RE47,331 E * 4/2019 Fenster ..... A63B 22/04
10,532,247 B2 * 1/2020 Coray ..... A63B 22/025
2006/0281604 A1 * 12/2006 Stewart ..... A63B 22/0023 482/51
2008/0125291 A1 * 5/2008 Watt ..... A63B 22/0007 482/52
2010/0099541 A1 * 4/2010 Patel ..... A63B 21/00181 482/52
2011/0177917 A1 * 7/2011 Patel ..... A63B 21/00181 482/52
2012/0238409 A1 * 9/2012 Halsey ..... A63B 22/04 482/52
2012/0264572 A1 * 10/2012 Fenster ..... A63B 22/04 482/52
2015/0165263 A1 * 6/2015 Golen, Jr. ..... A63B 22/04 482/7
2015/0190671 A1 * 7/2015 Golen, Jr. ..... A63B 22/04 482/52
2015/0335974 A1 * 11/2015 Levesque ..... H02K 7/1861 482/2
2018/0326256 A1 * 11/2018 Coray ..... A63B 71/0036
2019/0022455 A1 * 1/2019 Kueker ..... A63B 22/04
2020/0038706 A1 * 2/2020 Liu ..... A63B 22/0005

* cited by examiner

CLIMBING MACHINE

BACKGROUND OF THE INVENTION

1. Field of the Invention

The invention relates to exercise machines and more particularly to a climbing machine having a magnetic resistance controlling device for adding difficulty to doing the motion.

2. Description of Related Art

A conventional climbing machine is shown in FIGS. 18 and 19 and comprises an inclined upright 52, a handlebar 50 mounted on an upper portion of the upright 52, two inclined parallel rails 521 having one ends secured to two sides of an intermediate portion and the other ends rested on the ground, two pedals 54 slidably mounted on the rails 521 respectively, a first set of two boards 541 mounted on a bottom of one pedal 54, a second set of two boards 541 mounted on a bottom of the other pedal 54, and a mechanism 56 including four wheels 561 mounted a bottom of an upper portion of one rail 521, a bottom of a lower portion of one rail 521, a bottom of an upper portion of the other rail 521, and a bottom of a lower portion of the other rail 521 respectively, a first steel rope 562 having one end secured to one board 541 of the first set and the other end passing two lower wheels 561 to secure to one board 541 of the second set, and a second steel rope 562 having one end secured to the other board 541 of the first set and the other end passing two upper wheels 561 to secure to the other board 541 of the second set.

In motion, two feet of an individual stand on the pedals 54. One foot may pump one pedal 54 down along one rail 521 and the first steel rope 562 moves to pump the other pedal 54 up along the other rail 521. The above operation may be performed alternately upward and downward.

However, no damping device is provided by the conventional climbing machine. Thus, its benefits are limited. Further, the upward and downward movements of the pedals 54 are very quick and are not easy to control. For balancing the movements, the individual may hold the handlebar 50 tightly and this is not comfortable.

Thus, the need for improvement still exists.

SUMMARY OF THE INVENTION

It is therefore one object of the invention to provide a climbing machine comprising a base; two handlebars extending upward from the base; two sets of two inclined parallel rails wherein each rail has one end secured to a joining portion of the handlebar and the base and the other end rested on the ground; two pedals slidably mounted on the rails respectively; two spaced first wheels mounted forwardly of the rails; a magnetic resistance controlling device configured to add difficulty to motion and including a conductive disc, a curved groove member releasably secured to the conductive disc, a plurality of magnetic elements disposed on two inner walls of the curved groove member, an axle in the base, and at least one roller each rotatably mounted on the axle, and having twos ends disposed externally of the conductive disc; and at least one first rope each extending from the first wheel to wind around the roller prior to attaching to the pedal; wherein in response to rotating the roller, the conductive disc rotates.

Preferably, in response to pumping one pedal down, the first rope is pulled to rotate the roller, and in turn the magnetic resistance controlling device rotates.

The invention has the following advantages and benefits in comparison with the conventional art: difficulty is added to the motion. Benefits due to exercise are greatly increased. The movement of the pedal is decreased due to the increased resistance. The machine can be easily moved to any place prior to use. An individual may keep his or her balance in the motion without holding handlebars. Stroke distance of the step, frequency of changing from the left leg to the right leg and vice versa, and exercise rate can be adjusted to an optimum for fitting his or her weight. Further, the climbing machine is applicable to people of any ages or serves as rehabilitation equipment for patients having injured knees.

The above and other objects, features and advantages of the invention will become apparent from the following detailed description taken with the accompanying drawings.

DETAILED DESCRIPTION OF THE INVENTION

Figure 1:
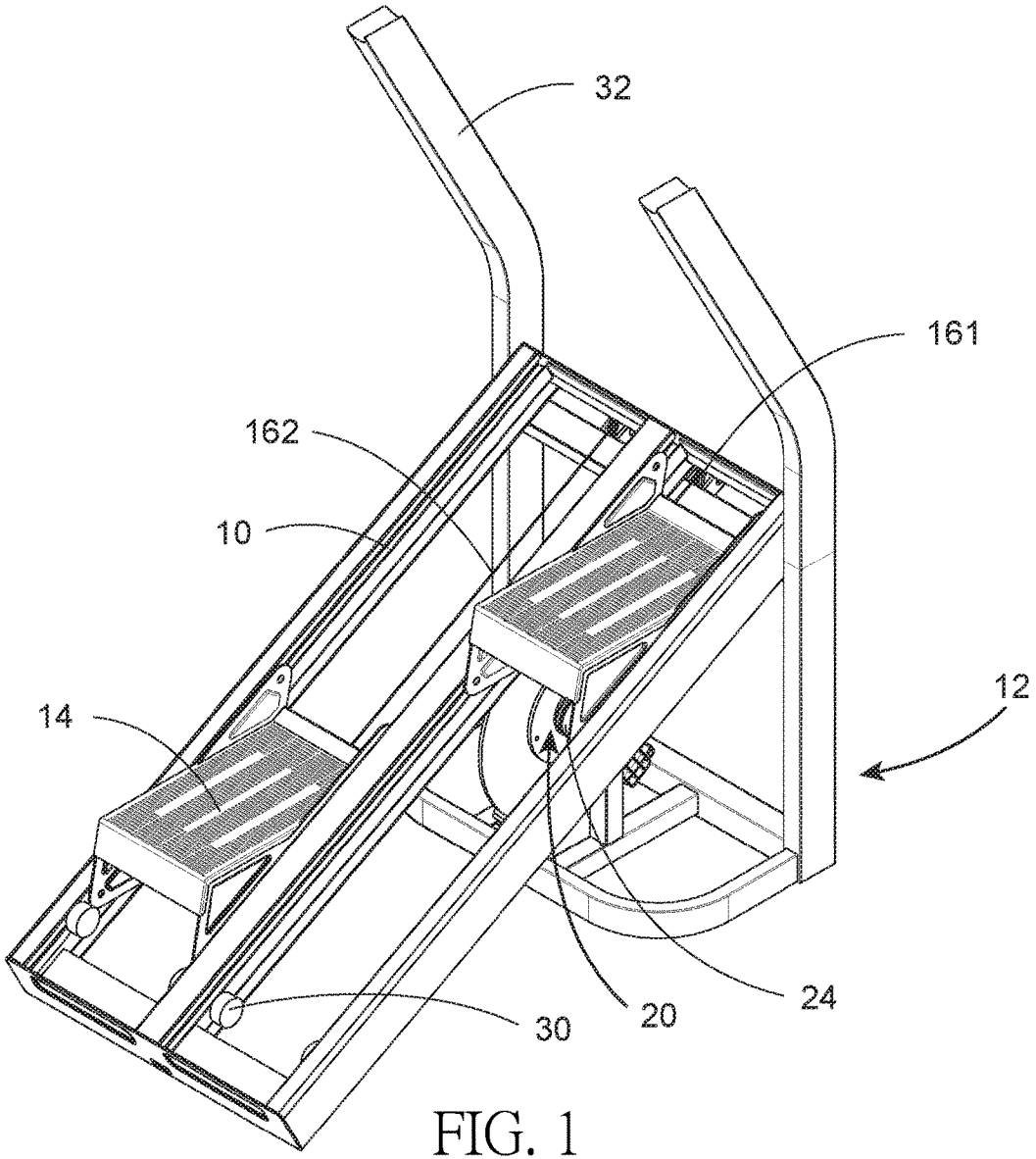
FIG. 1 is a perspective view of a climbing machine according to a first preferred embodiment of the invention.
Figure 2:
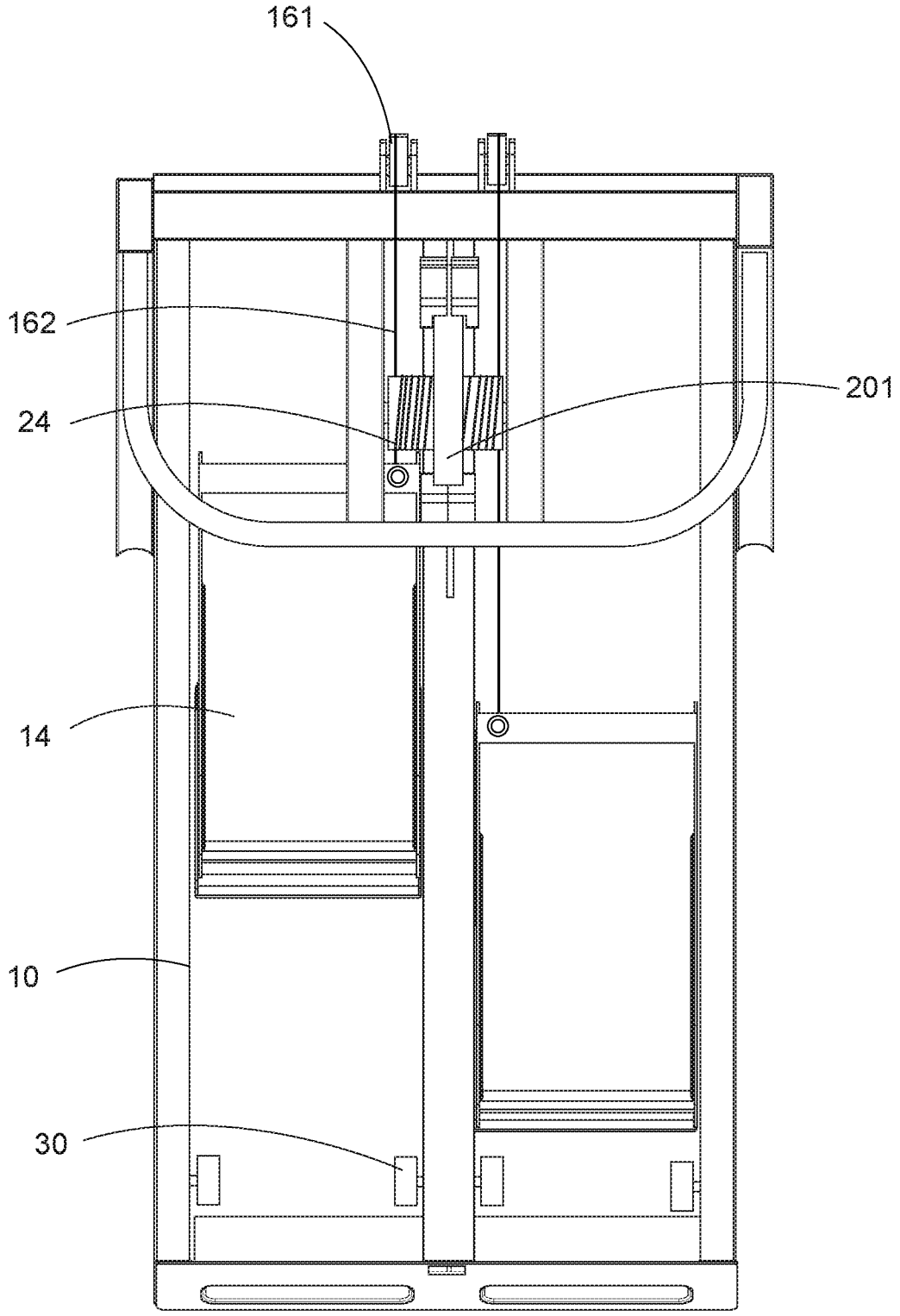
FIG. 2 is a bottom view of FIG. 1.

Referring to FIGS. 1, 2, 9 and 10, a climbing machine in accordance with a first preferred embodiment of the invention comprises a base 12, two handlebars 32 extending upward, rearward from the base 12, two sets of two inclined parallel rails 10 in which each rail 10 has one end secured to a joining portion of the handlebar 32 and the base 12 and the other end rested on the ground, two pedals 14 slidably mounted on the rails 10 respectively, two spaced first wheels 161 mounted forwardly of the rails 10, a magnetic resistance controlling device 20 for adding difficulty to motion and including an axle 22 disposed in the base 12 and one roller 24 (see FIG. 9) (or two rollers 24 (see FIG. 10)) rotatably mounted on the axle 22, two first ropes 162 each extending from the first wheel 161 to clockwise (or counterclockwise) wind around the roller 24. Entrance point of the first rope 162 and exit point thereof are symmetrical with respect to an axle of the roller 24. Further, the entrance point of the first rope 162 and the exit point thereof are oriented along two opposite tangents respectively. Furthermore, the entrance point of the first rope 162 and the exit point thereof are parallel so that the roller 24 can be rotated by pulling the first rope 162. Two opposite limit members 30 are provided on lower portions of the rails 10 of the same set respectively.

In motion, two feet of an individual stand on the pedals 14. One foot may pump one pedal 14 down along the rails 10 of one set and in turn the first rope 162 connected to the pedal 14 pulls downward. Further, the first rope 162 connected to the other pedal 14 pulls upward with the magnetic resistance controlling device 20 rotated due to the pulling of the first ropes 162. As a result, an adhesive friction is generated by the magnetic resistance controlling device 20. The downward movement of the pedal 14 will be stopped when the pedal 14 contacts the limit members 30 of the same set. The provision of the limit members 30 not only prevents the pedal 14 from hitting a bottom end of the rails 10 but also functions as a buffer.

Figure 3:
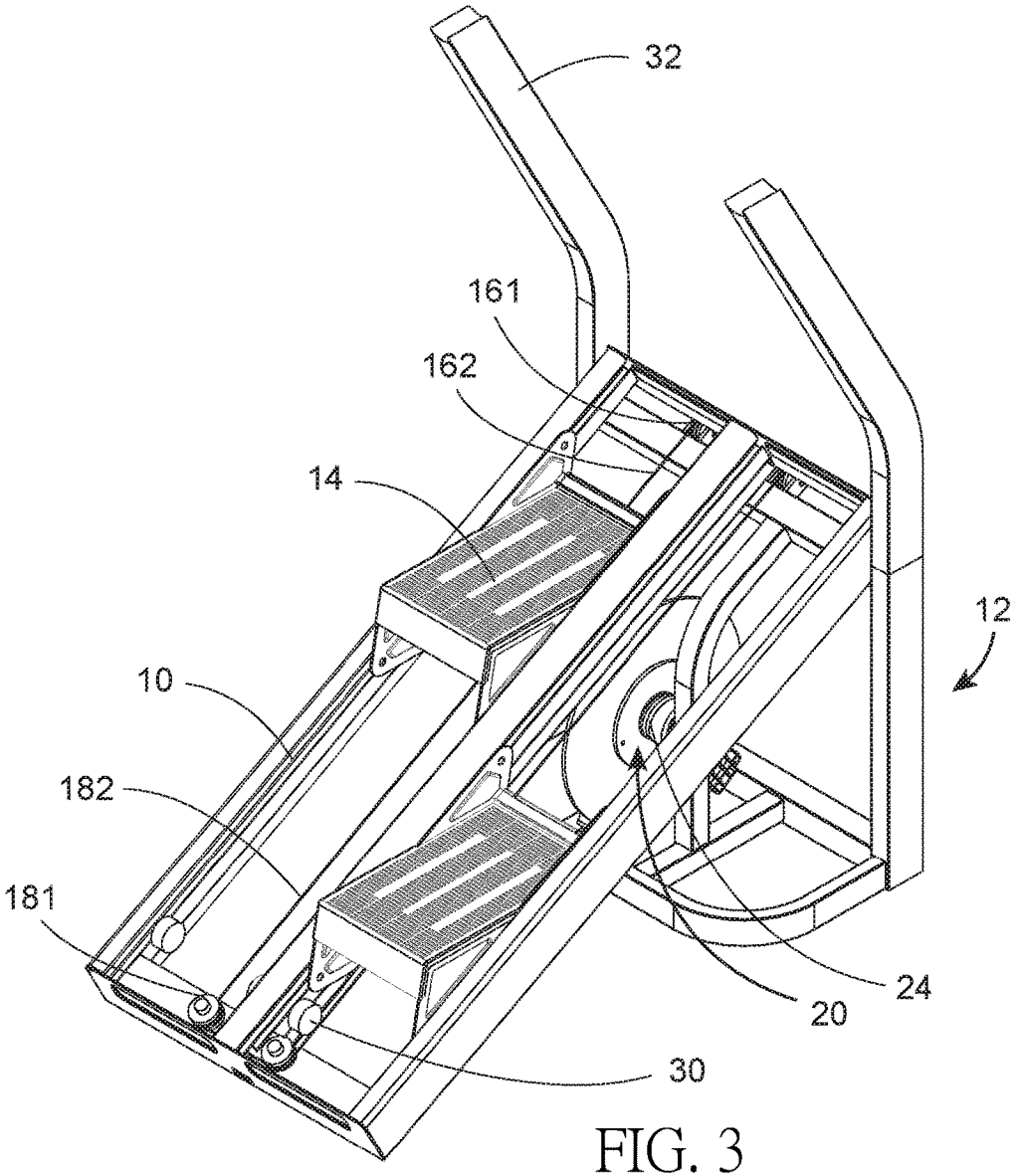
FIG. 3 is a perspective view of a climbing machine according to a second preferred embodiment of the invention.
Figure 4:
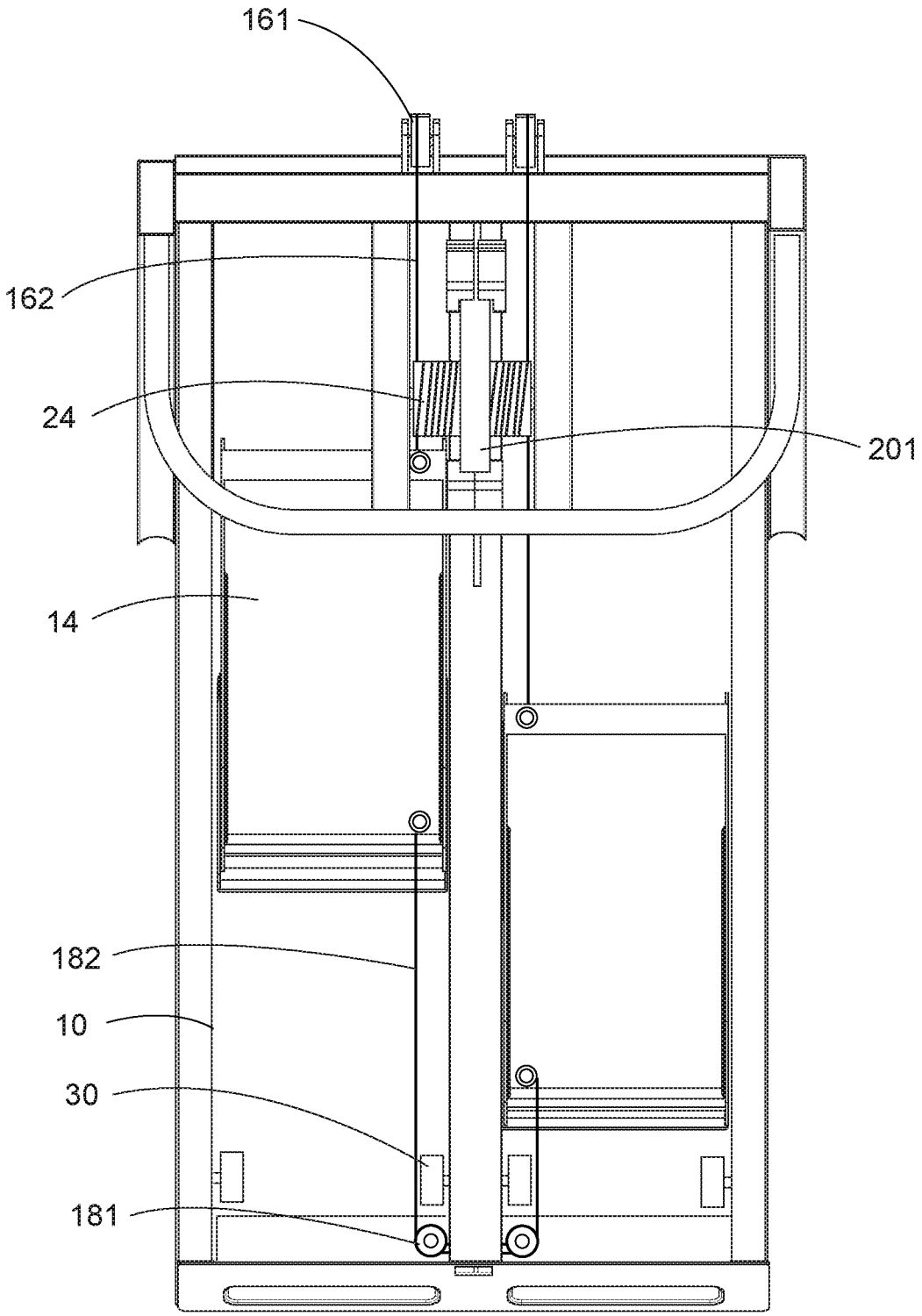
FIG. 4 is a bottom view of FIG. 3.
Figure 9:
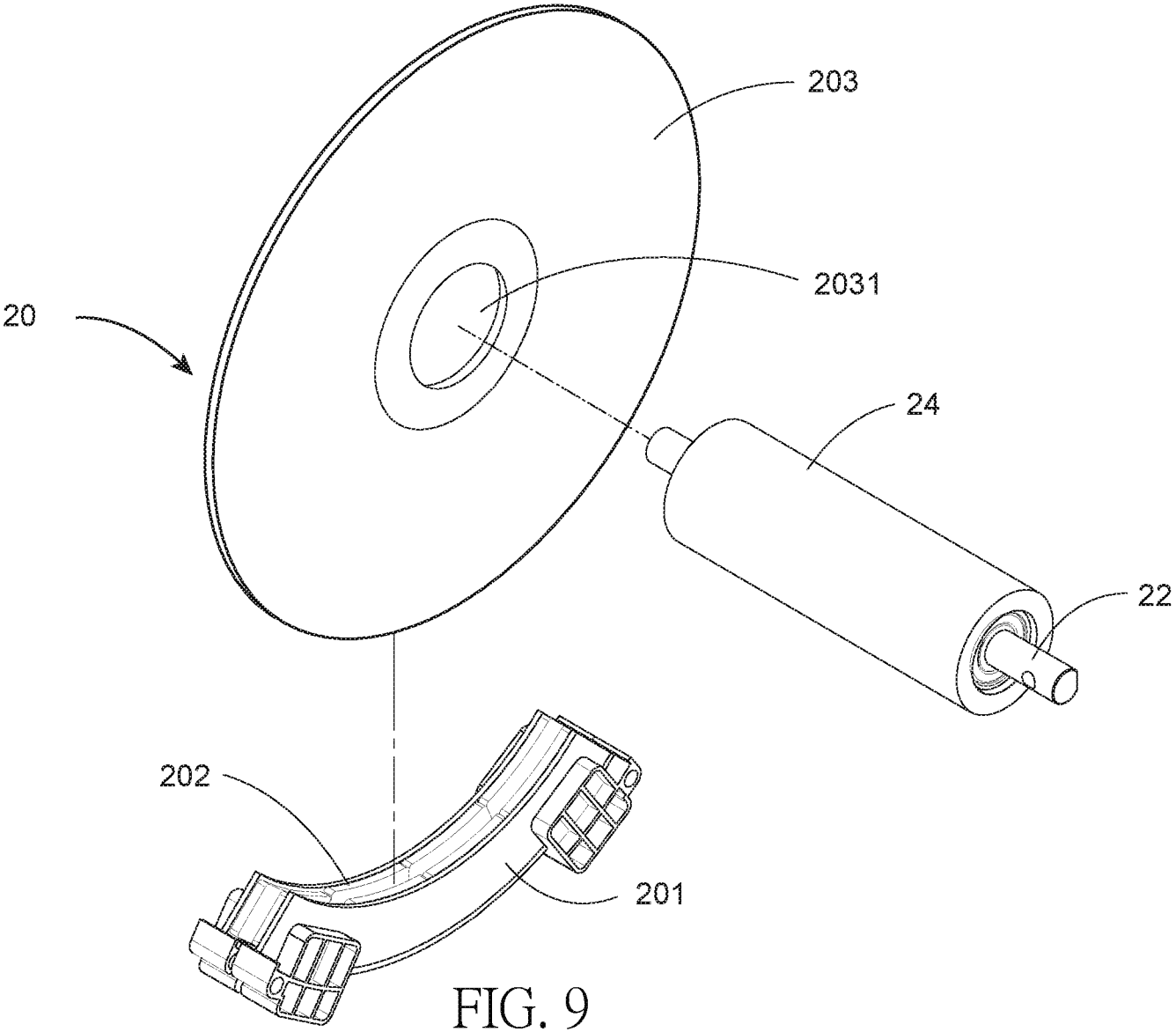
FIG. 9 is an exploded view of one wheel mounted on a magnetic resistance controlling device.
Figure 10:
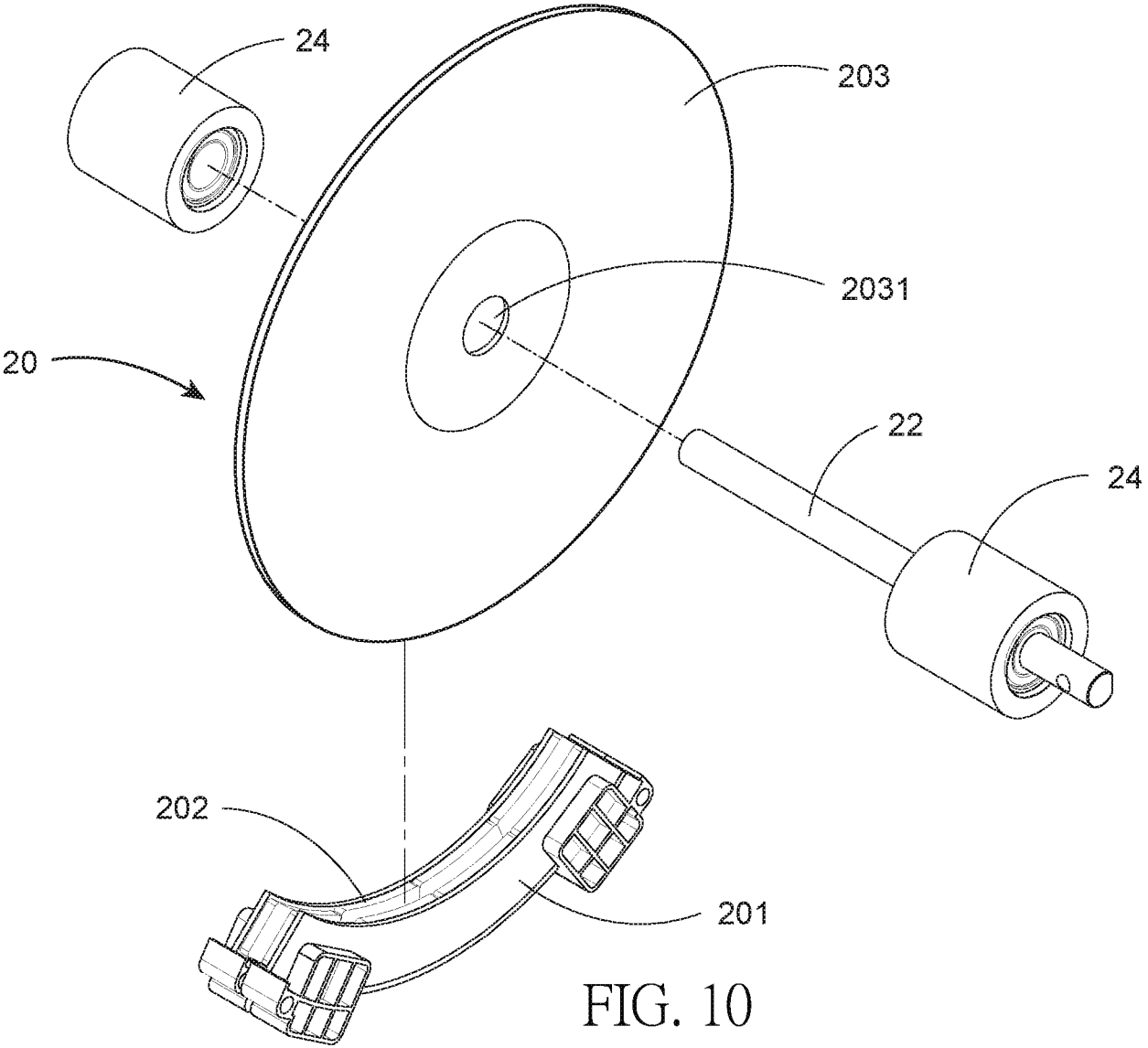
FIG. 10 is an exploded view of two wheels mounted on the magnetic resistance controlling device.

Referring to FIGS. 3 and 4 in conjunction with FIGS. 9 and 10, a climbing machine in accordance with a second preferred embodiment of the invention is shown. The characteristics of the second preferred embodiment are substantially the same as that of the first preferred embodiment except the following: Two spaced second wheels 181 are provided on a bottom end of the rails 10. One end of a second rope 182 is secured to one pedal 14, the second rope 182 further passes the second wheels 181, and the other end thereof is secured to the other pedal 14. The provision of the second wheels 181 and the second rope 182 smoothes the pulling of the first ropes 162.

Figure 5:
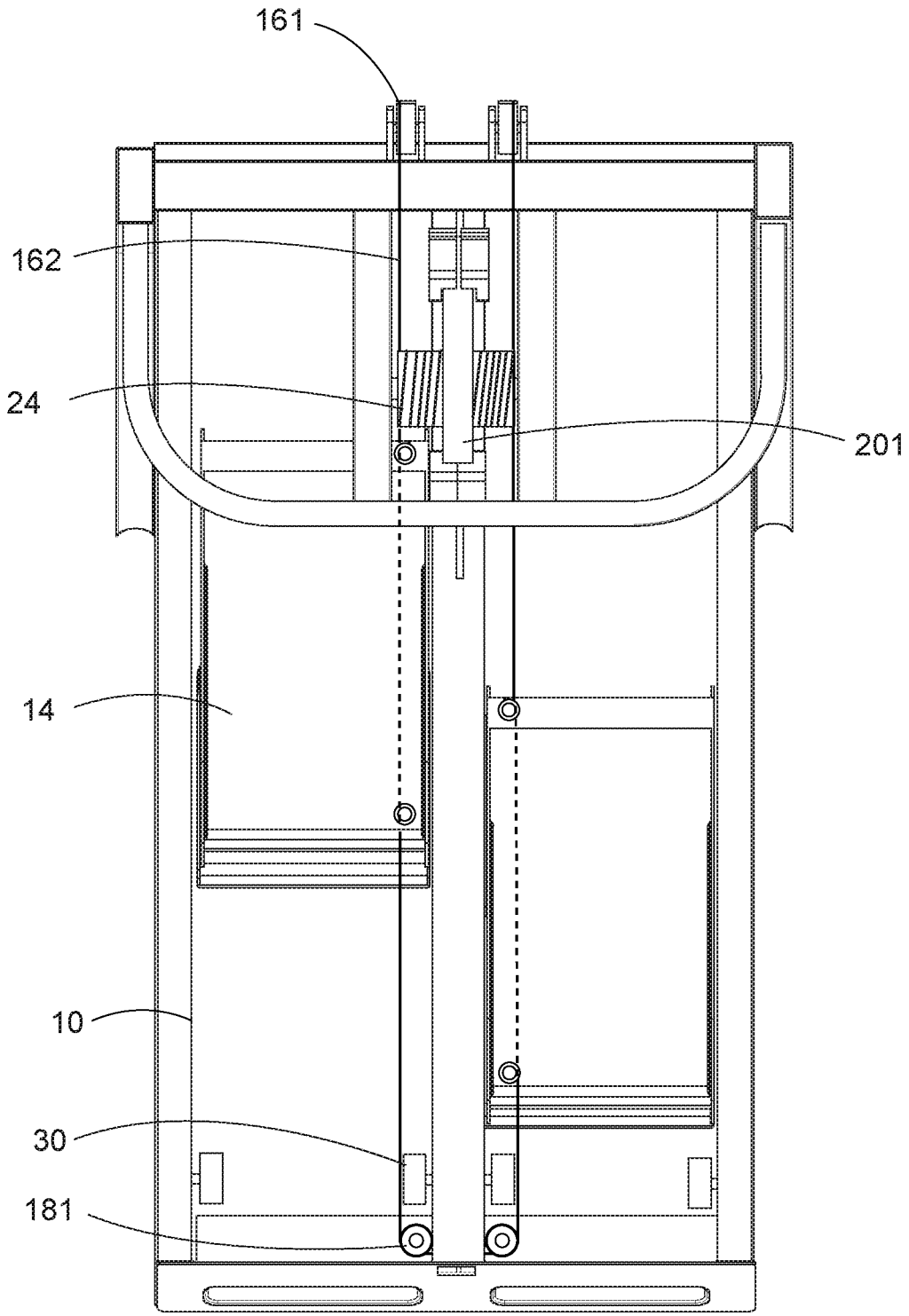
FIG. 5 is a bottom view of a climbing machine according to a third preferred embodiment of the invention.

Referring to FIG. 5, a climbing machine in accordance with a third preferred embodiment of the invention is shown. The characteristics of the third preferred embodiment are substantially the same as that of the first or second preferred embodiment except the following: Two spaced second wheels 181 are provided on a bottom end of the rails 10. One end of one first rope 162 is secured to one end of one roller 24, one first rope 162 is wound around one roller 24 and passes the first wheel 161 and the second wheel 181, and the other end thereof is secured to the other end of one roller 24. One end of the other first rope 162 is secured to one end of the other roller 24, the other first rope 162 is wound around the other roller 24 and passes the first wheel 161 and the second wheel 181, and the other end thereof is secured to the other end of the other roller 24.

Figure 6:
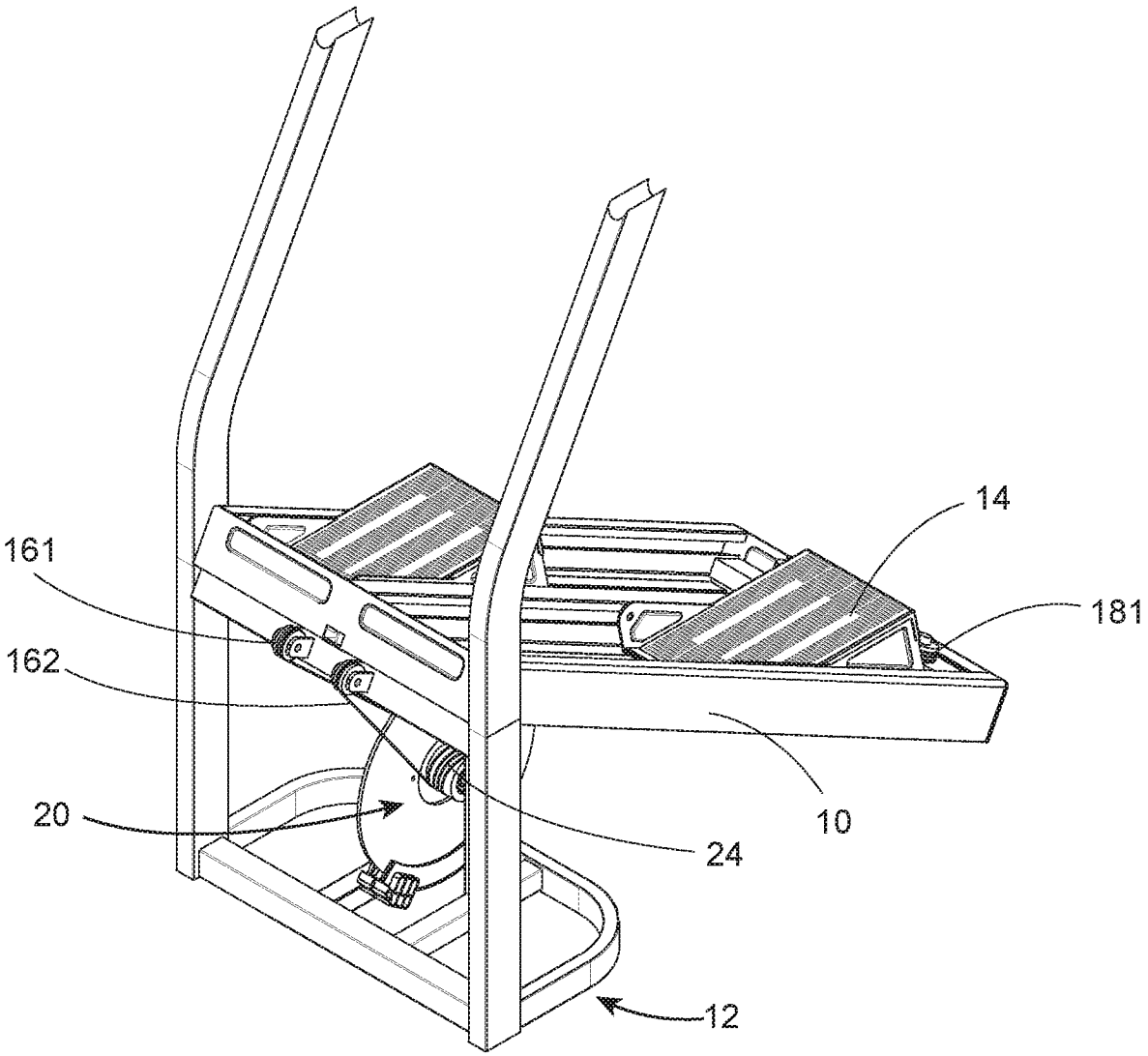
FIG. 6 is another perspective view of a climbing machine according to the second preferred embodiment of the invention.
Figure 8:
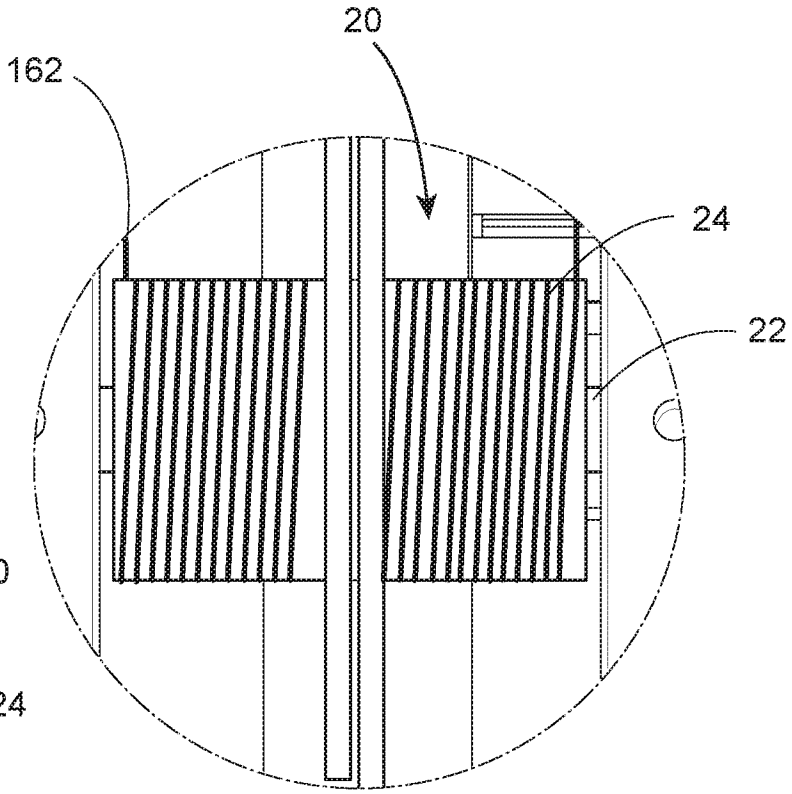
FIG. 8 is a detailed view of the area in circle VIII of FIG. 7.
Figure 7:
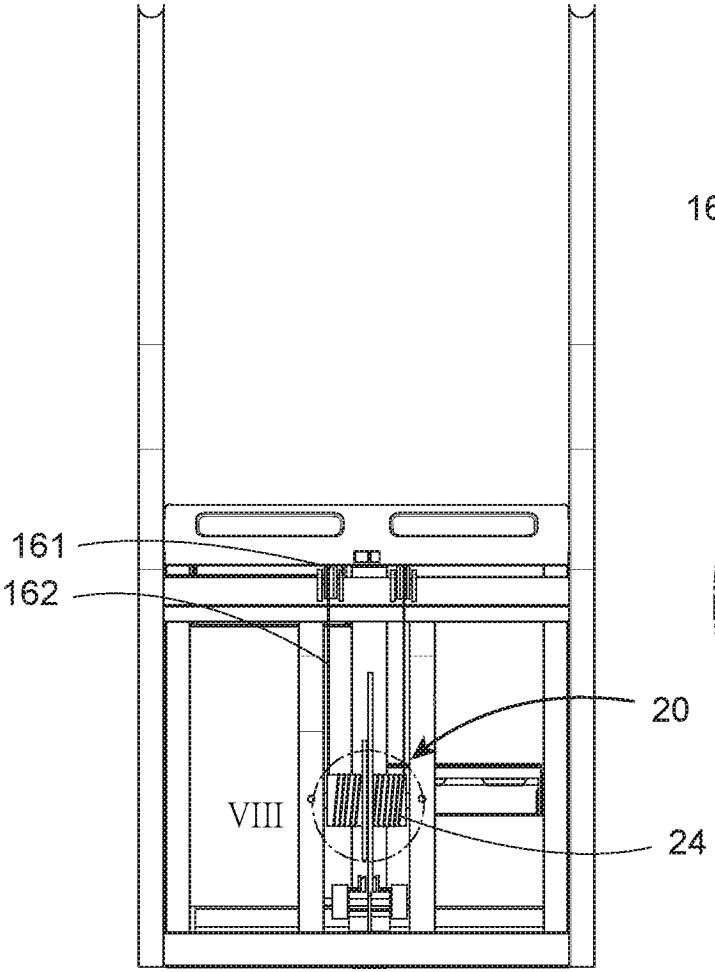
FIG. 7 is a rear view of the climbing machine according to the second preferred embodiment of the invention.

Referring to FIGS. 6 to 8, the pulling in or letting out operation of the first rope 162 on the roller 24 is discussed below. Two feet of an individual stand on the pedals 14. One foot may pump one pedal 14 down along the rails 10 of one set and in turn the first rope 162 connected to the pedal 14 pulls downward. The provision of the first wheel 161 attached to one end of the first rope 162 prevents the first rope 162 from contacting the base 12 to generate undesired friction. The first rope 162 is wound around the rollers 24 which pass through a central portion of the magnetic resistance controlling device 20. An upward pulling of the right first rope 162 rotates the rollers 24. And in turn, the left first rope 162 is wound around the rollers 24. Likewise, an upward pulling of the left first rope 162 rotates the rollers 24. And in turn, the right first rope 162 is wound around the rollers 24. The rollers 24 rotate either clockwise or counterclockwise in above operations.

It is noted that when only one first rope 162 is used the first rope 162 touches a rear portion of the left side of the axle 24 and clockwise winds around the roller 24. Further, the first rope 162 leaves the roller 24 at a front portion of the right side of the roller 24. Finally, the first rope 162 terminates at the first wheel 161. That is, the entrance point of the first rope 162 on the roller 24 and the exit point of the first rope 162 on the roller 24 are at different planes.

As shown in FIGS. 9 and 10 specifically, it shows the size of a hole through a center of the magnetic resistance controlling device 20 can be changed in response to the shape of the axle 22 or the diameter of the roller 24.

Figure 12:
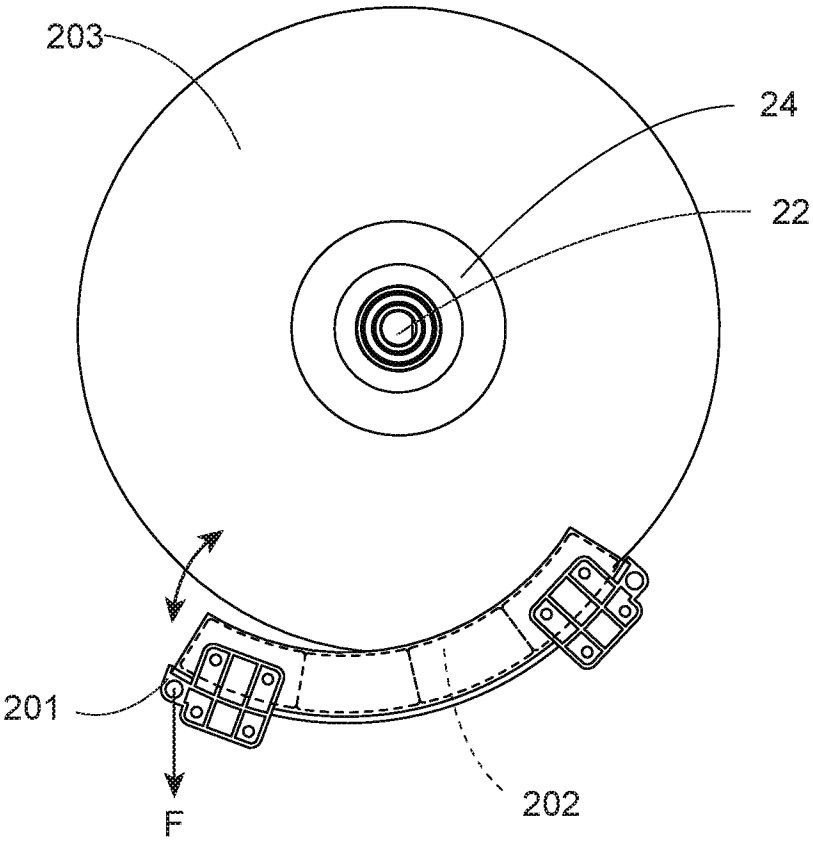
FIGS. 11 and 12 schematically depict operations of the magnetic resistance controlling device respectively.
Figure 11:
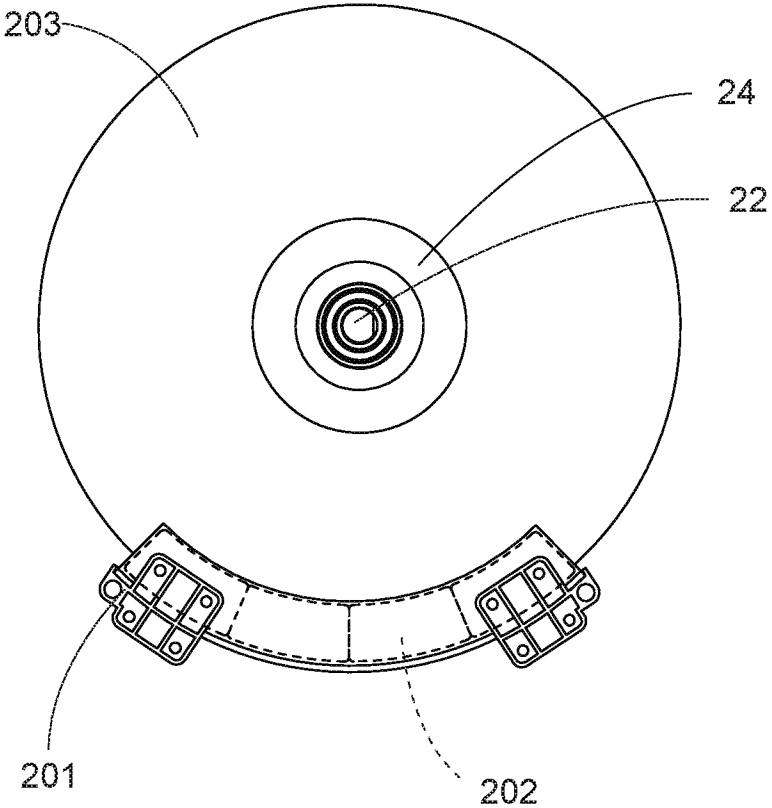

Referring to FIGS. 9, 11 and 12 in conjunction with FIGS. 6 and 7, the roller 24 is pivotably disposed on the axle 22. The magnetic resistance controlling device 20 includes a conductive disc 203 and a curved groove member 201 releasably secured to an edge of the conductive disc 203. The magnetic resistance controlling device 20 further comprises a plurality of magnetic elements 202 provided on two inner walls of the curved groove member 201.

As shown in FIGS. 11 and 12 specifically, it is possible of adjusting a distance between the magnetic elements 202 and the conductive disc 203 by repositioning the curved groove member 201 with respect to the conductive disc 203. As a result, resistance to be generated will be changed.

As shown in FIG. 11 specifically, resistance is increased when the curved groove member 201 is proximate the conductive disc 203. As shown in FIG. 12 specifically, resistance is decreased when the curved groove member 201 is distal the conductive disc 203. When a bore of a central opening 2031 of the conductive disc 203 is greater than a diameter of the roller 24, an inner end of the roller 24 is at one side of the conductive disc 203. When the roller 24 is disposed through the central opening 2031 of the conductive disc 203, the conductive disc 203 is clamped by the roller 24. In other words, in response to rotating the roller 24 by winding the first rope 162 around the roller 24, the conductive disc 203 rotates. The number of the first rope 162 is one or two. In case of one first rope 162, two ends of the first rope 162 are attached to the pedals 14 respectively and an intermediate portion thereof is wound around the roller 24. In case of two first ropes 162, one ends of the first ropes 162 are attached to the pedals 14 respectively, intermediate portions of the first ropes 162 are wound around the rollers 24 after passing the first wheels 161, and the other ends of the first ropes 162 are attached to both sides of the roller 24 respectively.

Referring to FIG. 10 in conjunction with FIGS. 6 and 7, two rollers 24 are pivotably mounted on two ends of the axle 22. When a bore of the central opening 2031 of the conductive disc 203 is greater than a diameter of the axle 22 but less than a diameter of the roller 24, and the axle 22 is disposed through the central opening 2031 of the conductive disc 203, the axle 22 is clamped by the conductive disc 203 and the rollers 24 are disposed at two sides of the conductive disc 203 respectively. As such, the rollers 24 and the conductive disc 203 are assembled. Either of two first ropes 162 is attached to the roller 24. In other words, the number of the first ropes 162 is two. One ends of the first ropes 162 are attached to the pedals 14 respectively, and intermediate portions of the first ropes 162 are wound around the rollers 24 in two opposite directions after attaching to the first wheels 161, and the other ends of the first ropes 162 are attached to both sides of the roller 24 respectively.

Entrance point of the first rope 162 and exit point thereof are symmetrical with respect to an axle of the roller 24. Further, the entrance point of the first rope 162 and the exit point thereof are oriented along two opposite tangents respectively. Furthermore, the other ends of the first ropes 162 are attached to the rollers 24 respectively. Thus, the roller 24 can be rotated by pulling the first rope 162. As a result, the conductive disc 203 rotates.

Figure 14:
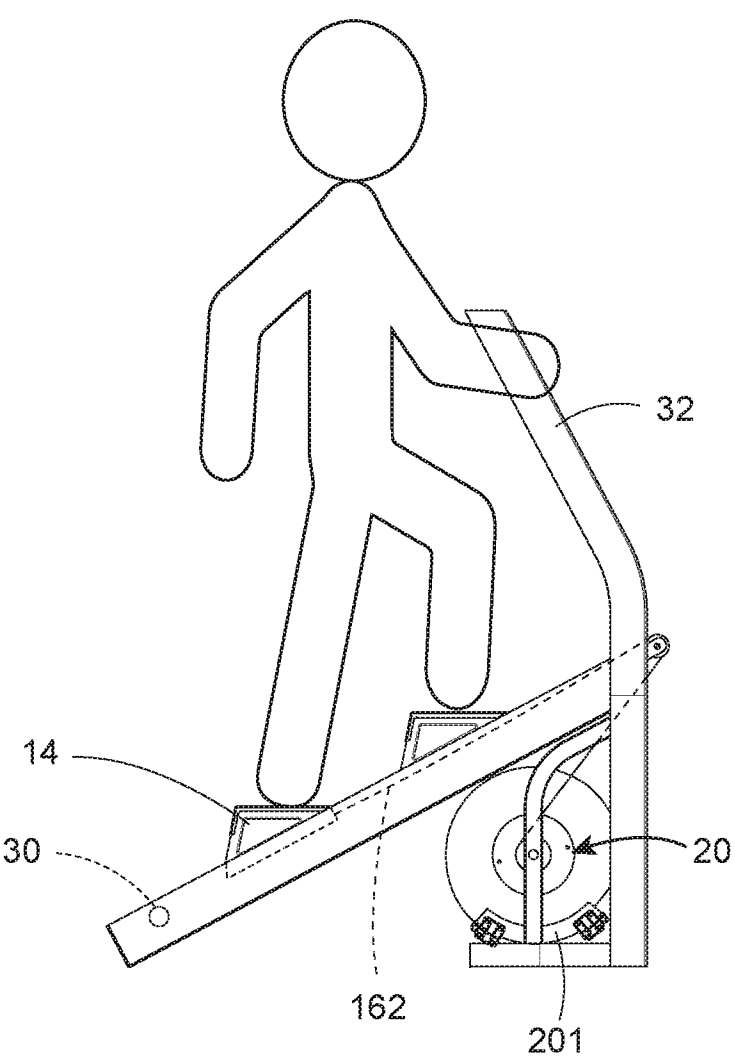
FIGS. 13 and 14 are side elevations schematically depicting use of the climbing machine according to the first preferred embodiment of the invention respectively.
Figure 13:
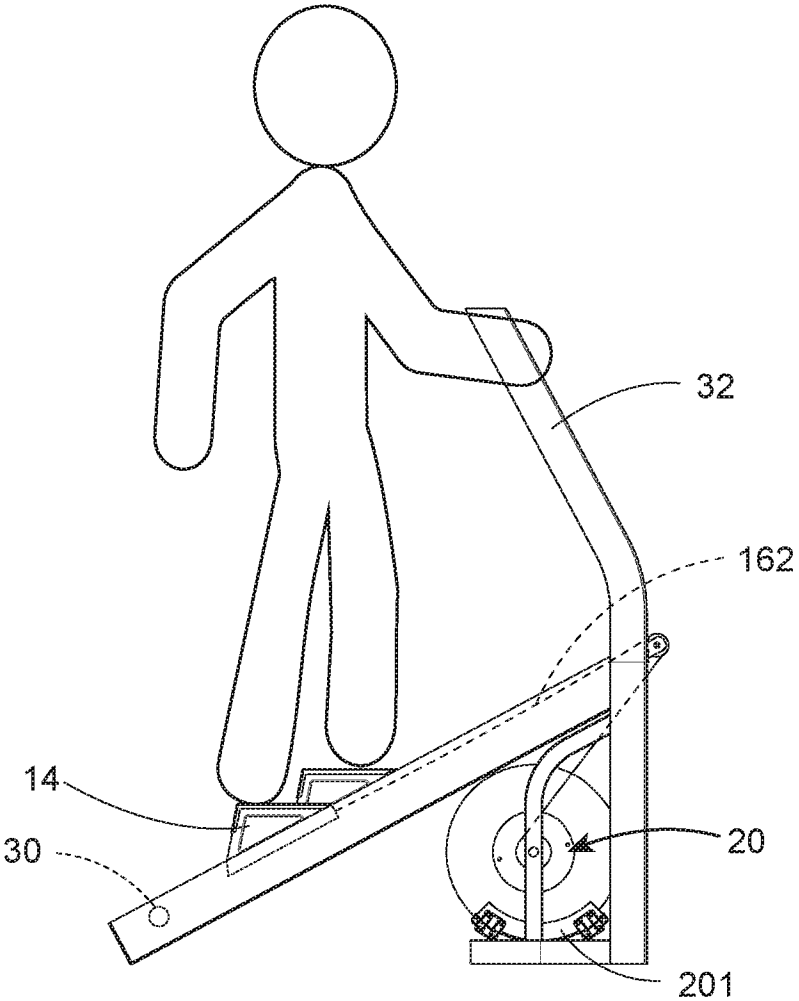

Referring to FIGS. 13 and 14, an individual may adjust the adhesive friction generated by the climbing machine of the invention to fit his (or her) weight. As a result, stroke distance of the step, frequency of changing from the left leg to the right leg and vice versa, and exercise rate can be adjusted to an optimum.

Figure 15:
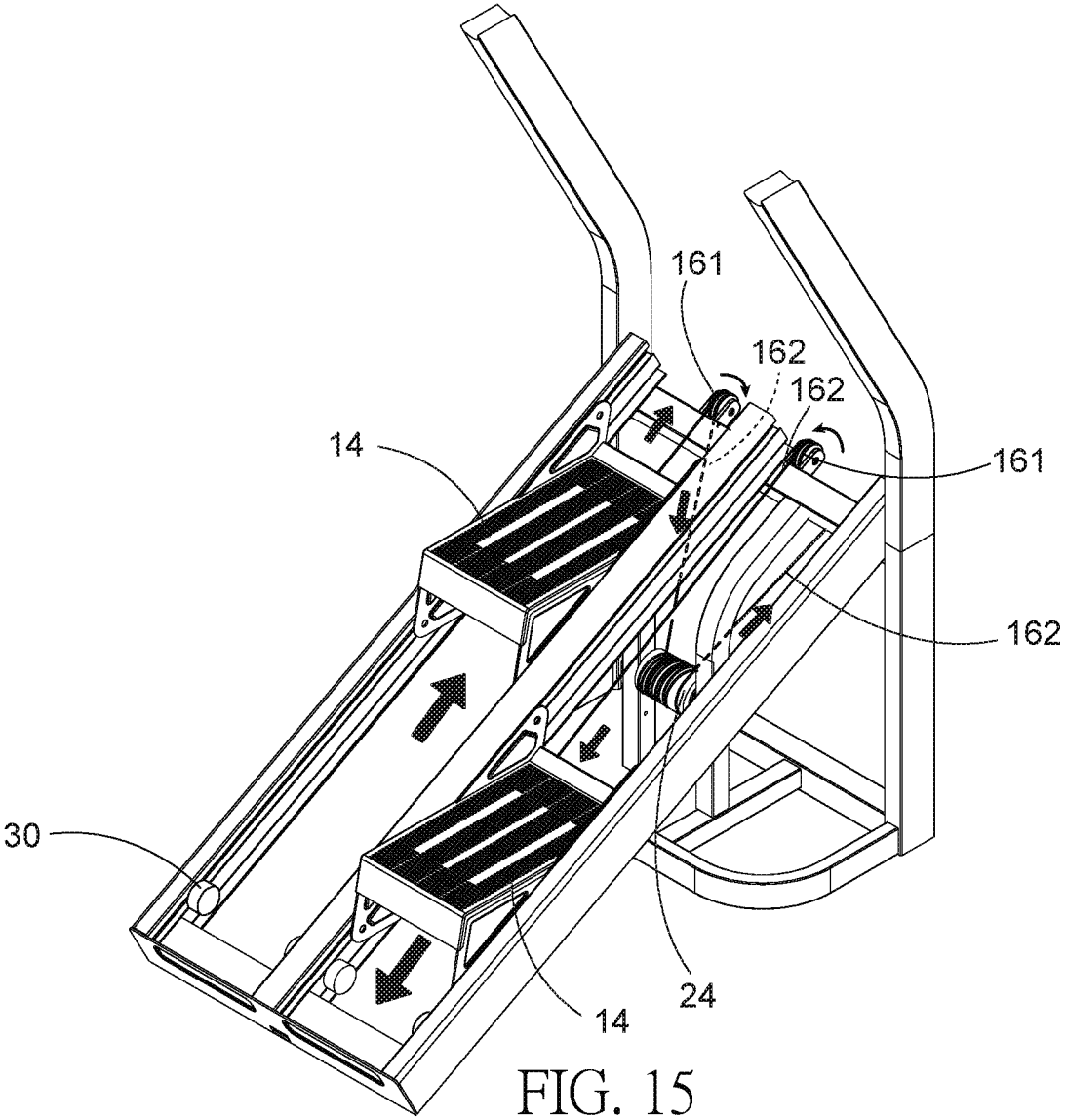
FIG. 15 is a perspective view showing a rotation of a first rope on the wheel when one pedal moves upward and the other pedal moves downward.

Referring to FIG. 15, a pulling movement of the first rope 162 is discussed in detail below. In addition to the magnetic resistance controlling device 20 of FIGS. 13 and 14, one roller 24 and one first rope 162 are taken as exemplary example. Further, characteristics of the right side and the left side of the roller 24 are detailed below.

As shown in FIG. 15, in motion, one foot may pump one pedal 14 down and in turn the roller 24 clockwise rotates. The first rope 162 to the right of the roller 24 is pulled upward to pass the right first wheel 161. Further, the first rope 162 is pulled downward toward the right pedal 14. Next, the roller 24 to the left of the first rope 162 is wound clockwise. At the same time, the left pedal 14 moves upward due to the winding operation of the left first rope 162.

Referring to FIGS. 16A to 17B, rotational movements of the first rope 162 around the roller 24 is detailed below.

Figure 16A:
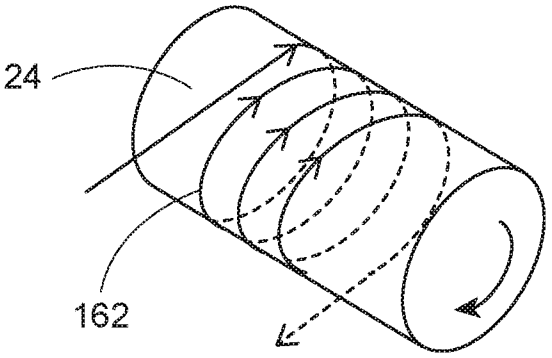
FIG. 16A schematically shows a winding of the first rope on the wheel.
Figure 16B:
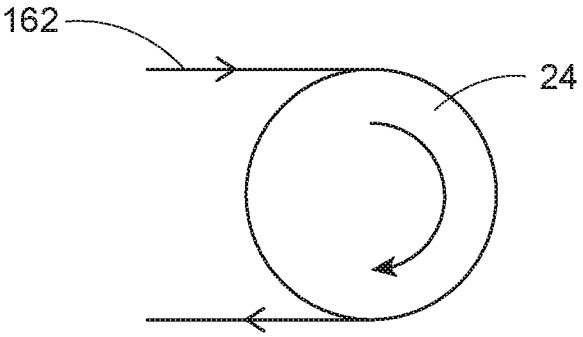
FIG. 16B is a side view of FIG. 16A showing a clockwise rotation of the first wheel.

In FIGS. 16A and 16B, the first rope 162 is clockwise wound around the roller 24. In response to pulling the first rope 162, the roller 24 may rotate clockwise. To the contrary, if the first rope 162 is counterclockwise wound around the roller 24 and in response to pulling the first rope 162, the roller 24 may rotate counterclockwise (not shown).

Figure 17A:
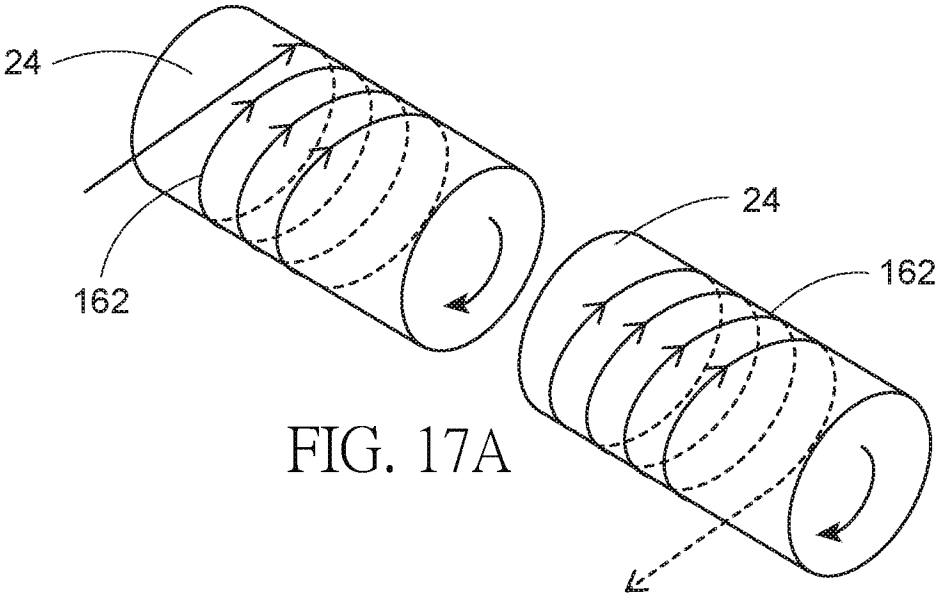
FIG. 17A schematically shows a winding of the two first ropes on the two wheels respectively.
Figure 17B:
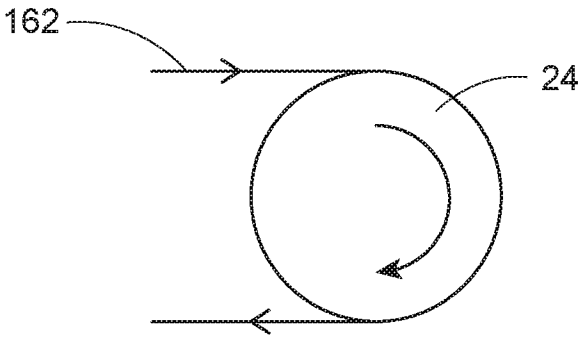
FIG. 17B is a side view of FIG. 17A showing a clockwise rotation of the first wheel.
Figure 18:
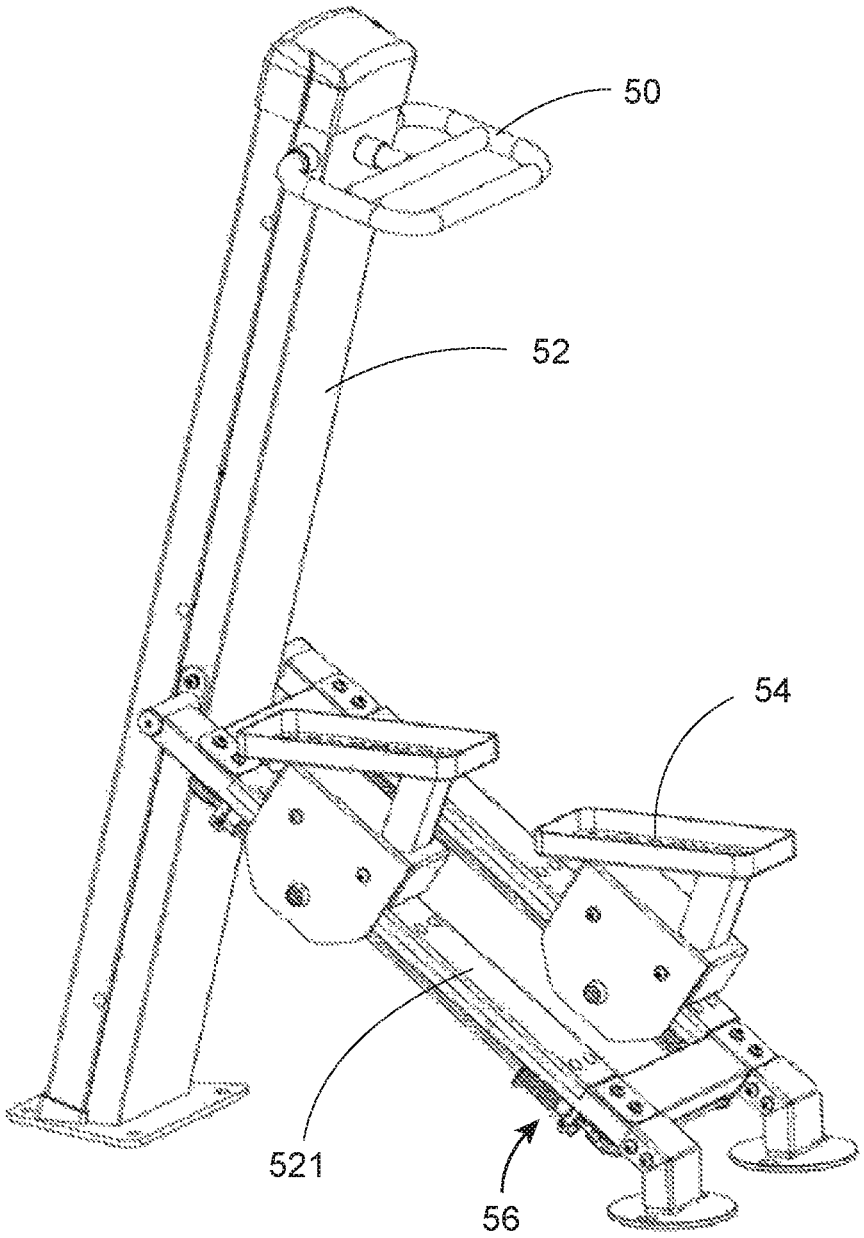
PRIOR ART FIG. 18
FIG. 18 is a perspective view of a conventional climbing machine.
Figure 19:
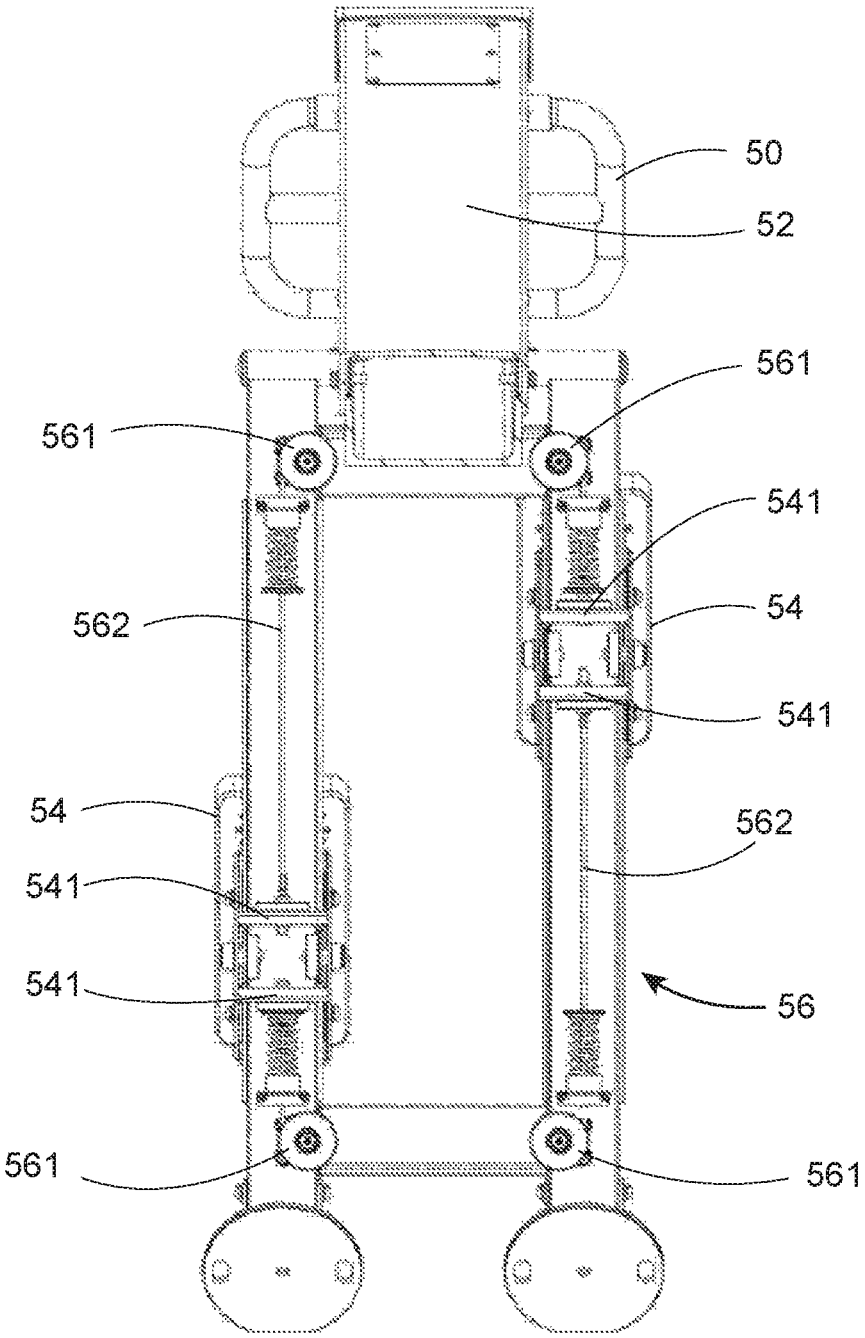
PRIOR ART FIG. 19
FIG. 19 is a bottom view of the climbing machine of FIG. 18.

In FIGS. 17A and 17B, the two first ropes 162 are clockwise wound around the two rollers 24 respectively. In response to pulling one first rope 162, the corresponding roller 24 may rotate clockwise. To the contrary, if the first ropes 162 are counterclockwise wound around the rollers 24 respectively and in response to pulling the first ropes 162, the rollers 24 may rotate counterclockwise (not shown).

Alternatively, one first rope 162 is clockwise wound around one roller 24 and the other first rope 162 is counterclockwise wound around the other roller 24. In response to pulling one first rope 162, both the rollers 24 may rotate clockwise (not shown). To the contrary, if one first rope 162 is counterclockwise wound around one roller 24 and the other first rope 162 is clockwise wound around the other roller 24. In response to pulling one first rope 162, both the rollers 24 may rotate counterclockwise (not shown).

Entrance point of the first rope 162 and exit point thereof are symmetrical with respect to an axle of the roller 24 irrespective of clockwise or counterclockwise winding of the first rope 162 around the roller 24. Further, the entrance point of the first rope 162 and the exit point thereof are oriented along two opposite tangents respectively. Furthermore, the entrance point of the first rope 162 and the exit point thereof are parallel.

While the invention has been described in terms of preferred embodiments, those skilled in the art will recognize that the invention can be practiced with modifications within the spirit and scope of the appended claims.

What is claimed is:

1. A climbing machine, comprising:

a base;

two handlebars extending upward from the base;

two sets of two inclined parallel rails wherein each rail has one end secured to a joining portion of a respective handlebar and the base and the other end rested on the ground;

two pedals slidably mounted on the rails respectively;

two spaced first wheels mounted forwardly of the rails;

a magnetic resistance controlling device configured to add difficulty to motion and including a conductive disc, a curved groove member releasably secured to the conductive disc, a plurality of magnetic elements disposed on two inner walls of the curved groove member, an axle disposed in the base, and at least one roller each rotatably mounted on the axle, and having two ends disposed externally of the conductive disc; and at least one first rope each extending from the first wheel to wind around the roller prior to attaching to the pedal;

wherein in response to rotating the roller, the conductive disc rotates.

2. The climbing machine of claim 1, wherein the number of the at least one first rope is two; wherein the number of the at least one roller is two; wherein one ends of the first ropes are attached to the pedals respectively, intermediate portions of the first ropes are wound around the rollers after passing the first wheels, and the other ends of the first ropes are attached to two sides of the rollers respectively; and wherein a central opening of the conductive disc has a diameter greater than a diameter of the roller.

3. The climbing machine of claim 1, wherein the number of the at least one first rope is two; wherein the number of the at least one roller is two; wherein the conductive disc is clamped by the rollers; wherein one ends of the first ropes are attached to the pedals respectively, intermediate portions of the first ropes are wound around the rollers after passing the first wheels, and the other ends of the first ropes are attached to the rollers respectively; wherein a diameter of the conductive disc is greater than that of the roller; and wherein in response to rotating the rollers by the first ropes, the conductive disc rotates.

4. The climbing machine of claim 1, wherein an entrance point of the first rope and an exit point thereof are symmetrical with respect to an axle of the roller irrespective of clockwise or counterclockwise winding of the first rope around the roller; wherein the entrance point of the first rope and the exit point thereof are oriented along two opposite tangents respectively; and wherein the entrance point of the first rope and the exit point thereof are parallel.

5. The climbing machine of claim 2, wherein an entrance point of the first rope and an exit point thereof are symmetrical with respect to an axle of the roller irrespective of clockwise or counterclockwise winding of the first rope around the roller; wherein the entrance point of the first rope and the exit point thereof are oriented along two opposite tangents respectively; and wherein the entrance point of the first rope and the exit point thereof are parallel.

6. The climbing machine of claim 3, wherein an entrance point of the first rope and an exit point thereof are symmetrical with respect to an axle of the roller irrespective of clockwise or counterclockwise winding of the first rope around the roller; wherein the entrance point of the first rope and the exit point thereof are oriented along two opposite tangents respectively; and wherein the entrance point of the first rope and the exit point thereof are parallel.

7. The climbing machine of claim 2, wherein one first rope is clockwise wound around one roller and the other first rope is counterclockwise wound around the other roller; wherein an entrance point of the first rope and an exit point thereof are symmetrical with respect to an axle of the roller; wherein the entrance point of the first rope and the exit point thereof are oriented along two opposite tangents respectively; and wherein the entrance point of the first rope and the exit point thereof are parallel.

8. The climbing machine of claim 3, wherein one first rope is clockwise wound around one roller and the other first rope is counterclockwise wound around the other roller; wherein an entrance point of the first rope and an exit point thereof are symmetrical with respect to an axle of the roller; wherein the entrance point of the first rope and the exit point thereof are oriented along two opposite tangents respectively; and wherein the entrance point of the first rope and the exit point thereof are parallel.

9. The climbing machine of claim 1, wherein the curved groove member is releasably secured to an edge of the conductive disc.

10. The climbing machine of claim 1, further comprising a plurality of limit members on lower portions of the rails of the same set respectively; and wherein the limit members correspond to either pedal.

11. The climbing machine of claim 2, further comprising a plurality of limit members on lower portions of the rails of the same set respectively; and wherein the limit members correspond to either pedal.

12. The climbing machine of claim 3, further comprising a plurality of limit members on lower portions of the rails of the same set respectively; and wherein the limit members correspond to either pedal.

13. The climbing machine of claim 1, further comprising a plurality of second wheels on a bottom end of the rails, and a second rope; and wherein one end of the second rope is secured to one pedal, the second rope further passes the second wheels, and the other end thereof is secured to the other pedal.

14. The climbing machine of claim 2, further comprising a plurality of second wheels on a bottom end of the rails, and a second rope; and wherein one end of the second rope is secured to one pedal, the second rope further passes the second wheels, and the other end thereof is secured to the other pedal.

15. The climbing machine of claim 3, further comprising a plurality of second wheels on a bottom end of the rails, and a second rope; and wherein one end of the second rope is secured to one pedal, the second rope further passes the second wheels, and the other end thereof is secured to the other pedal.

16. The climbing machine of claim 1, further comprising a plurality of second wheels on a bottom end of the rails; and wherein one end of the first rope is secured to one roller, the first rope further passes the second wheels, and the other end thereof is secured to the other roller.

17. The climbing machine of claim 2, further comprising a plurality of second wheels on a bottom end of the rails; and wherein one end of the first rope is secured to one roller, the first rope further passes the second wheels, and the other end thereof is secured to the other roller.

18. The climbing machine of claim 3, further comprising a plurality of second wheels on a bottom end of the rails; and wherein one end of the first rope is secured to one roller, the first rope further passes the second wheels, and the other end thereof is secured to the other roller.

19. The climbing machine of claim 1, wherein an entrance point of the first rope on the roller and an exit point of the first rope on the roller are at different planes.

* * * * *